US008627600B2

(12) United States Patent
Gao et al.

(10) Patent No.: US 8,627,600 B2
(45) Date of Patent: Jan. 14, 2014

(54) PINCH PROTECTION MECHANISM UTILIZING ACTIVE MATERIAL ACTUATION

(75) Inventors: Xiujie Gao, Troy, MI (US); Craig A. Kollar, Sterling Heights, MI (US); Nancy L. Johnson, Northville, MI (US); Alan L. Browne, Grosse Pointe, MI (US); Pablo D. Zavattieri, West Lafayette, IN (US); Nilesh D. Mankame, Ann Arbor, MI (US); Paul W. Alexander, Ypsilanti, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 550 days.

(21) Appl. No.: 12/764,687

(22) Filed: Apr. 21, 2010

(65) Prior Publication Data

US 2011/0258931 A1 Oct. 27, 2011

(51) Int. Cl.
*E05F 15/02* (2006.01)

(52) U.S. Cl.
USPC ..... 49/26

(58) Field of Classification Search
USPC ..... 49/26, 27, 28; 200/61.43; 296/146.9
See application file for complete search history.

(56) References Cited

U.S. PATENT DOCUMENTS

| | | | | |
|---|---|---|---|---|
| 5,907,213 | A * | 5/1999 | Oshima et al. | 310/328 |
| 6,108,978 | A * | 8/2000 | Jeong | 49/440 |
| 7,362,040 | B2 * | 4/2008 | Neubauer et al. | 310/330 |
| 8,042,303 | B2 * | 10/2011 | Gandhi | 49/441 |
| 2004/0070316 | A1 | 4/2004 | Neubauer et al. | |
| 2007/0114116 | A1 * | 5/2007 | Nagai et al. | 200/181 |

* cited by examiner

*Primary Examiner* — Katherine Mitchell
*Assistant Examiner* — Catherine A Kelly

(57) ABSTRACT

A pinch-protection mechanism adapted for use with a closure panel and method for use of the same, said mechanism comprising at least one structural component defining an adjustable edge section manipulable between first and second configurations and an active material element coupled to the component, such that the change causes or enables the edge section to be manipulated to one of said first and second configurations, and manipulating the edge section between said first and second configurations eliminates, warns of, or mitigates a pinch condition.

10 Claims, 4 Drawing Sheets

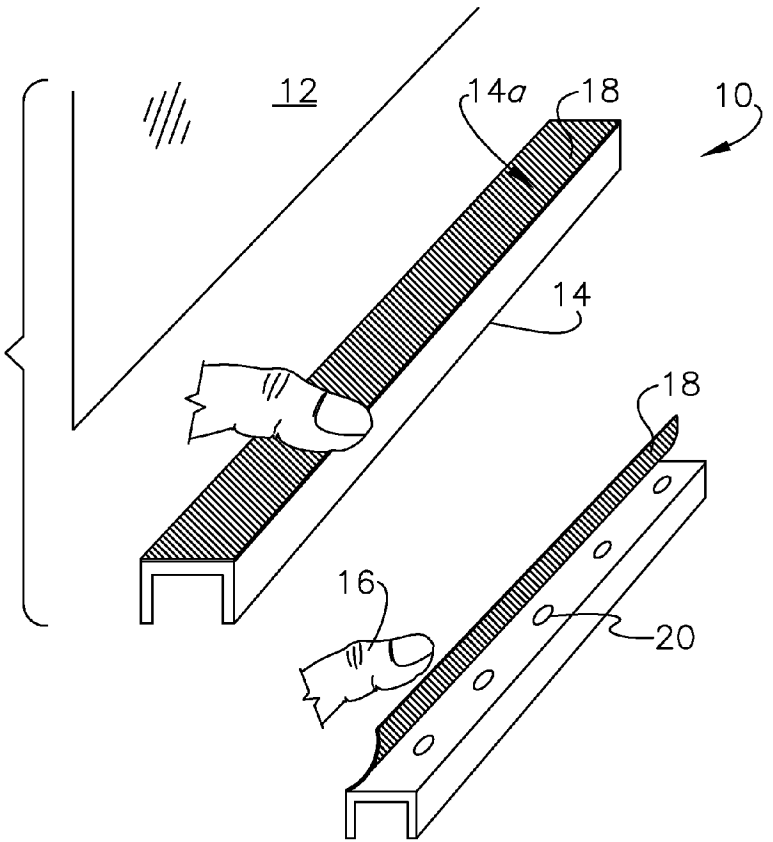
FIG. 1
FIG. 1a
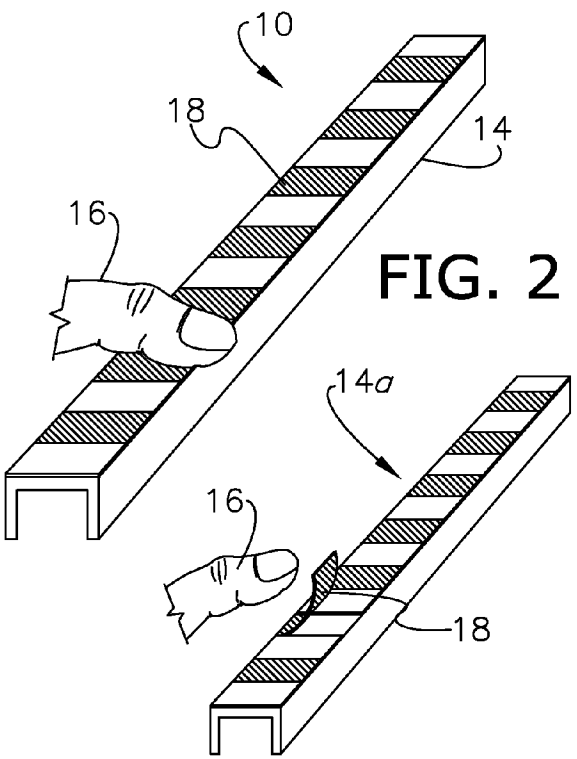
FIG. 2
FIG. 2a

PINCH PROTECTION MECHANISM UTILIZING ACTIVE MATERIAL ACTUATION

BACKGROUND OF THE INVENTION

1. Field of the Invention

The present disclosure generally relates to pinch protection mechanisms for closure panels, and in particular, to pinch protection mechanisms that utilize active material actuation to eliminate, warn of, or mitigate a pinch condition.

2. Discussion of the Prior Art

Closure panels, such as doors and gates, are typically associated with a structural component that engages with the panel to achieve a closed position. In many applications, the engagement generally results in continuous contact between the panel and an interior edge or perimeter defined by the component. As the panel closes, however, hands, fingers, and other objects inadvertently disposed intermediate the panel and edge may prevent proper engagement and can become pinched therebetween, thereby possibly resulting in damage. Recent safety measures designed to reduce the likelihood of pinch conditions have combined controlling the motorized closing of the panel, and a "pinching strip," wherein the pinching strip detects the presence of an object, and signals the motor to abort closure and/or re-open the panel. Use of these measures, however, presents various concerns in the art, including, for example, increased manufacturing and repair costs, the requirement of an actual pinch condition, and a limitation in application to motorized closure panels.

BRIEF SUMMARY OF THE INVENTION

Responsive to these and other concerns, the present invention recites pinch protection mechanisms that preferably utilize active material actuation to actively eliminate, warn of, or mitigate a pinch condition. In the plural embodiments described, the invention is useful for providing pinch protection for both powered and non-powered closure panels. Where employing active material actuation, the invention is further useful for providing a pinch prevention solution at reduced cost and packaging requirements in comparison to the prior art.

In general, the invention concerns a pinch-prevention mechanism adapted for use with a closure panel, wherein the panel is moveable between open and closed positions, so as to define a closing path. The mechanism includes at least one structural component defining an adjustable edge section. The edge section is manipulable between first and second configurations. The component and panel are cooperatively configured such that the panel engages the edge section when in the closed position. The mechanism further includes an active material element operable to undergo a reversible change in fundamental property when exposed to or occluded from an activation signal, and coupled to the component. The change causes, enables, or facilitates the edge section to be manipulated to one of said first and second configurations; and manipulating the edge section between the first and second configurations eliminates, warns of, or mitigates a pinch condition.

The disclosure may be understood more readily by reference to the following detailed description of the various features of the disclosure and the examples included therein.

BRIEF DESCRIPTION OF THE SEVERAL VIEWS OF THE DRAWING

Preferred embodiments of the invention are described in detail below with reference to the attached drawing figures of the exemplary scale, wherein:

FIG. 1 is a perspective view of a component edge adapted to engage a closure panel, engaging an obstruction, and including a continuous active material cover shown in a superjacent configuration, in accordance with a preferred embodiment of the invention;

FIG. 1*a* is a perspective view of the edge and cover shown in FIG. 1, wherein the cover has been activated to achieve a second curled configuration that causes the obstruction to be removed, and particularly illustrating a plurality of sensors underneath the cover;

FIG. 2 is a perspective view of a component edge engaging an obstruction, and including a plurality of active material strips shown in a first superjacent configuration, in accordance with a preferred embodiment of the invention;

FIG. 2*a* is a perspective view of the edge and strips shown in FIG. 2, wherein at least one strip has been activated to achieve a second curled configuration;

DETAILED DESCRIPTION OF THE PREFERRED EMBODIMENTS

Figure 3:
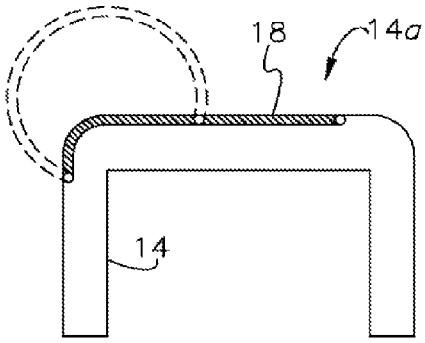
FIG. 3 is an elevation of a component edge adapted to engage a closure panel, and including an active material element presenting a first end pivotally and a second end pivotally and translatably coupled to the component, wherein the element is shown in a first superjacent configuration (in continuous-line type), and a bowed second configuration (in hidden-line type), in accordance with a preferred embodiment of the invention.
Figure 4A:
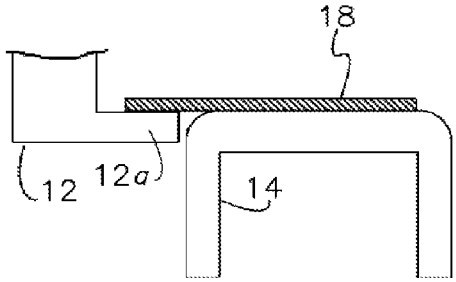
FIGS. 4*a-d* are a progression of a component edge including an active material element operable to achieve first superjacent and second curled configurations, and a closure panel, wherein the element functions to latch the panel in the closed condition and translate obstructions away from the edge when the panel is closing, in accordance with a preferred embodiment of the invention.
Figure 4B:
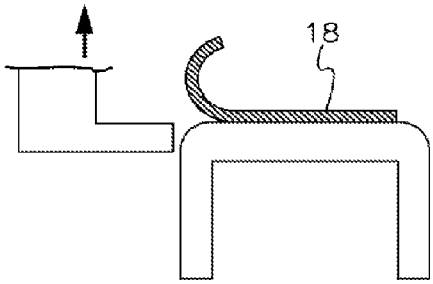
Figure 4D:
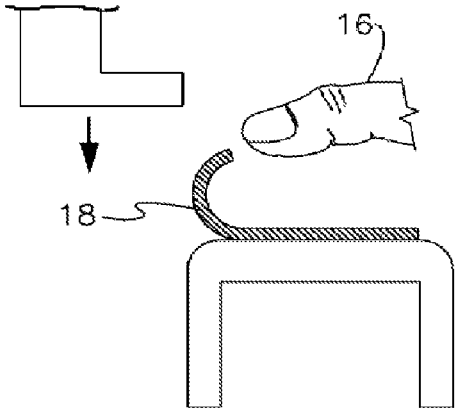
Figure 4C:
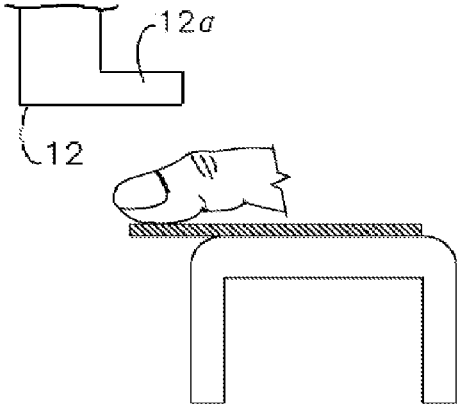

Referring to FIGS. 1-10, the present invention concerns a pinch protection mechanism 10 adapted for use with a closure panel 12 and structural component 14. The mechanism 10 preferably utilizes active material actuation to modify an edge 14*a* defined by the component 14, so as to eliminate, warn of, or mitigate a pinch condition; however, it is appreciated that conventional actuators may supplant the active material in the particular embodiments of the invention described herein. The description of which is understood as being merely exemplary in nature and is in no way intended to limit the invention, its application, or uses. It is appreciated that the invention may be utilized with door, and window applications, for example, with respect to a vehicle, or wherever pinch conditions may result from the select engagement of two components, machinery parts, etc.

The term "pinch condition" refers to any condition in which an obstruction (e.g., hand, finger, clothing, toy, etc.) 16 engages the edge 14*a* and is within the closure path of an opened closure panel 12. The term "closure panel" refers to a door, window, gate, hood panel, trunk panel, partition, or any other moveable barrier associated with a structural component with which a pinch condition can occur. This condition normally occurs as the panel 12 is being moved to a closed position in which it engages the edge 14*a*, wherein the movement is caused by a force, and the obstruction 16 bears the force undesirably. The closure panel 12 is able to achieve a closed position in which it engages the affiliated structural component 14 and at least one open position in which it does not. The path is defined by the movement of the panel 12 from the closed position to the open position or vice versa. In the illustrated embodiment, the term "structural component" may refer to a doorjamb, doorframe, window frame, door trim, gatepost, or any other support that engages a closure panel 12, when the panel 12 is in the closed position.

As used herein the term "active material" shall be afforded its ordinary meaning as understood by those of ordinary skill in the art, and includes any material or composite that exhibits a reversible change in a fundamental (e.g., chemical or intrinsic physical) property, when exposed to an external signal source. Thus, active materials shall include those compositions that can exhibit a change in stiffness properties, shape and/or dimensions in response to the activation signal, which can take the type for different active materials, of electrical, magnetic, thermal and like fields.

I. Active Material Discussion and Function

Suitable active materials for use with the present invention include but are not limited to shape memory materials such as shape memory alloys. Shape memory materials generally refer to materials or compositions that have the ability to remember their original at least one attribute such as shape, which can subsequently be recalled by applying an external stimulus. As such, deformation from the original shape is a temporary condition. In this manner, shape memory materials can change to the trained shape in response to an activation signal. Exemplary active materials include the afore-mentioned shape memory alloys (SMA), electroactive polymers (EAP), ferromagnetic SMA's, piezoelectric composites, electrostrictives, magnetostrictives, and paraffin wax, and various combinations of the foregoing materials, and the like. Additional suitable active materials include shear thinning fluids and magnetorheological fluids and elastomers whose stiffness/modulus can be modified through the application of a suitable external field.

More particularly, shape memory alloys (SMA's) generally refer to a group of metallic materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature. The term "yield strength" refers to the stress at which a material exhibits a specified deviation from proportionality of stress and strain. Generally, in the low temperature, or martensite phase, shape memory alloys can be plastically deformed and upon exposure to some higher temperature will transform to an austenite phase, or parent phase, returning to their shape prior to the deformation. Materials that exhibit this shape memory effect only upon heating are referred to as having one-way shape memory. Those materials that also exhibit shape memory upon re-cooling are referred to as having two-way shape memory behavior.

Shape memory alloys exist in several different temperature-dependent phases. The most commonly utilized of these phases are the so-called Martensite and Austenite phases discussed above. In the following discussion, the martensite phase generally refers to the more deformable, lower temperature phase whereas the austenite phase generally refers to the more rigid, higher temperature phase. When the shape memory alloy is in the martensite phase and is heated, it begins to change into the austenite phase. The temperature at which this phenomenon starts is often referred to as austenite start temperature (As). The temperature at which this phenomenon is complete is called the austenite finish temperature (Af).

When the shape memory alloy is in the austenite phase and is cooled, it begins to change into the martensite phase, and the temperature at which this phenomenon starts is referred to as the martensite start temperature (Ms). The temperature at which austenite finishes transforming to martensite is called the martensite finish temperature (Mf). Generally, the shape memory alloys are softer and more easily deformable in their martensitic phase and are harder, stiffer, and/or more rigid in the austenitic phase. In view of the foregoing, a suitable activation signal for use with shape memory alloys is a thermal activation signal having a magnitude to cause transformations between the martensite and austenite phases.

Shape memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory material will induce the martensite to austenite type transition, and the material will recover the original, annealed shape. Hence, one-way shape memory effects are only observed upon heating. Active materials comprising shape memory alloy compositions that exhibit one-way memory effects do not automatically reform, and will likely require an external mechanical force to reform the shape.

Intrinsic and extrinsic two-way shape memory materials are characterized by a shape transition both upon heating from the martensite phase to the austenite phase, as well as an additional shape transition upon cooling from the austenite phase back to the martensite phase. Active materials that exhibit an intrinsic shape memory effect are fabricated from a shape memory alloy composition that will cause the active materials to automatically reform themselves as a result of the above noted phase transformations. Intrinsic two-way shape memory behavior must be induced in the shape memory material through processing. Such procedures include extreme deformation of the material while in the martensite phase, heating-cooling under constraint or load, or surface modification such as laser annealing, polishing, or shot-peening. Once the material has been trained to exhibit the two-way shape memory effect, the shape change between the low and high temperature states is generally reversible and persists through a high number of thermal cycles. In contrast, active materials that exhibit the extrinsic two-way shape memory effects are composite or multi-component materials that combine a shape memory alloy composition that exhibits a one-way effect with another element that provides a restoring force to reform the original shape.

The temperature at which the shape memory alloy remembers its high temperature form when heated can be adjusted by slight changes in the composition of the alloy and through heat treatment. In nickel-titanium shape memory alloys, for instance, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the system with shape memory effects, superelastic effects, and high damping capacity.

Suitable shape memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like.

Thus, for the purposes of this invention, it is appreciated that SMA's exhibit a modulus increase of 2.5 times and a dimensional change of up to 8% (depending on the amount of pre-strain) when heated above their Martensite to Austenite phase transition temperature. It is appreciated that thermally induced SMA phase changes are one-way so that a biasing force return mechanism (such as a spring) would be required to return the SMA to its starting configuration once the applied field is removed. Joule heating can be used to make the entire system electronically controllable. Stress induced phase changes in SMA are, however, two way by nature. Application of sufficient stress when an SMA is in its Austenitic phase will cause it to change to its lower modulus Martensitic phase in which it can exhibit up to 8% of "superelastic" deformation. Removal of the applied stress will cause the SMA to switch back to its Austenitic phase in so doing recovering its starting shape and higher modulus.

Ferromagnetic SMA's (FSMA's), which are a sub-class of SMAs, may also be used in the present invention. These materials behave like conventional SMA materials that have a stress or thermally induced phase transformation between martensite and austenite. Additionally FSMA's are ferromagnetic and have strong magnetocrystalline anisotropy, which permit an external magnetic field to influence the orientation/fraction of field aligned martensitic variants. When the magnetic field is removed, the material may exhibit complete two-way, partial two-way or one-way shape memory. For partial or one-way shape memory, an external stimulus, temperature, magnetic field or stress may permit the material to return to its starting state. Perfect two-way shape memory may be used for proportional control with continuous power supplied. External magnetic fields are generally produced via soft-magnetic core electromagnets in automotive applications, though a pair of Helmholtz coils may also be used for fast response.

Suitable piezoelectric materials include, but are not intended to be limited to, inorganic compounds, organic compounds, and metals. With regard to organic materials, all of the polymeric materials with non-centrosymmetric structure and large dipole moment group(s) on the main chain or on the side-chain, or on both chains within the molecules, can be used as suitable candidates for the piezoelectric film. Exemplary polymers include, for example, but are not limited to, poly(sodium 4-styrenesulfonate), poly (poly(vinylamine) backbone azo chromophore), and their derivatives; polyfluorocarbons, including polyvinylidenefluoride, its co-polymer vinylidene fluoride ("VDF"), co-trifluoroethylene, and their derivatives; polychlorocarbons, including poly(vinyl chloride), polyvinylidene chloride, and their derivatives; polyacrylonitriles, and their derivatives; polycarboxylic acids, including poly(methacrylic acid), and their derivatives; polyureas, and their derivatives; polyurethanes, and their derivatives; bio-molecules such as poly-L-lactic acids and their derivatives, and cell membrane proteins, as well as phosphate bio-molecules such as phosphodilipids; polyanilines and their derivatives, and all of the derivatives of tetramines; polyamides including aromatic polyamides and polyimides, including Kapton and polyetherimide, and their derivatives; all of the membrane polymers; poly(N-vinyl pyrrolidone) (PVP) homopolymer, and its derivatives, and random PVP-co-vinyl acetate copolymers; and all of the aromatic polymers with dipole moment groups in the main-chain or side-chains, or in both the main-chain and the side-chains, and mixtures thereof.

Piezoelectric materials can also comprise metals selected from the group consisting of lead, antimony, manganese, tantalum, zirconium, niobium, lanthanum, platinum, palladium, nickel, tungsten, aluminum, strontium, titanium, barium, calcium, chromium, silver, iron, silicon, copper, alloys comprising at least one of the foregoing metals, and oxides comprising at least one of the foregoing metals. Suitable metal oxides include SiO2, Al2O3, ZrO2, TiO2, SrTiO3, PbTiO3, BaTiO3, FeO3, Fe3O4, ZnO, and mixtures thereof and Group VIA and IIB compounds, such as CdSe, CdS, GaAs, AgCaSe2, ZnSe, GaP, InP, ZnS, and mixtures thereof. Preferably, the piezoelectric material is selected from the group consisting of polyvinylidene fluoride, lead zirconate titanate, and barium titanate, and mixtures thereof.

Electroactive polymers include those polymeric materials that exhibit piezoelectric, pyroelectric, or electrostrictive properties in response to electrical or mechanical fields. An example of an electrostrictive-grafted elastomer with a piezoelectric poly(vinylidene fluoride-trifluoro-ethylene) copolymer. Materials suitable for use as an electroactive polymer may include any substantially insulating polymer or rubber (or combination thereof) that deforms in response to an electrostatic force or whose deformation results in a change in electric field. Exemplary materials suitable for use as a pre-strained polymer include silicone elastomers, acrylic elastomers, polyurethanes, thermoplastic elastomers, copolymers comprising PVDF, pressure-sensitive adhesives, fluoroelastomers, polymers comprising silicone and acrylic moieties, and the like. Polymers comprising silicone and acrylic moieties may include copolymers comprising silicone and acrylic moieties, polymer blends comprising a silicone elastomer and an acrylic elastomer, for example.

Materials used as an electroactive polymer may be selected based on one or more material properties such as a high electrical breakdown strength, a low modulus of elasticity-(for large or small deformations), a high dielectric constant, and the like. In one embodiment, the polymer is selected such that it has an elastic modulus at most about 100 MPa. In another embodiment, the polymer is selected such that it has a maximum actuation pressure between about 0.05 MPa and about 10 MPa, and preferably between about 0.3 MPa and about 3 MPa. In another embodiment, the polymer is selected such that it has a dielectric constant between about 2 and about 20, and preferably between about 2.5 and about 12. The present disclosure is not intended to be limited to these ranges. Ideally, materials with a higher dielectric constant than the ranges given above would be desirable if the materials had both a high dielectric constant and a high dielectric strength. In many cases, electroactive polymers may be fabricated and implemented as thin films. Thickness suitable for these thin films may be below 50 micrometers.

As electroactive polymers may deflect at high strains, electrodes attached to the polymers should also deflect without compromising mechanical or electrical performance. Generally, electrodes suitable for use may be of any shape and material provided that they are able to supply a suitable voltage to, or receive a suitable voltage from, an electroactive polymer. The voltage may be either constant or varying over time. In one embodiment, the electrodes adhere to a surface of the polymer. Electrodes adhering to the polymer are preferably compliant and conform to the changing shape of the polymer. Correspondingly, the present disclosure may include compliant electrodes that conform to the shape of an electroactive polymer to which they are attached. The electrodes may be only applied to a portion of an electroactive polymer and define an active area according to their geometry. Various types of electrodes suitable for use with the present disclosure include structured electrodes comprising metal traces and charge distribution layers, textured electrodes comprising varying out of plane dimensions, conductive greases such as carbon greases or silver greases, colloidal suspensions, high aspect ratio conductive materials such as carbon fibrils and carbon nanotubes, and mixtures of ionically conductive materials.

Shape memory polymers (SMP's) generally refer to a group of polymeric materials that demonstrate the ability to return to a previously defined shape when subjected to an appropriate thermal stimulus. Shape memory polymers are capable of undergoing phase transitions in which their shape is altered as a function of temperature. Generally, SMP's have two main segments, a hard segment and a soft segment. The previously defined or permanent shape can be set by melting or processing the polymer at a temperature higher than the highest thermal transition followed by cooling below that thermal transition temperature. The highest thermal transition is usually the glass transition temperature ($T_g$) or melting point of the hard segment. A temporary shape can be set by heating the material to a temperature higher than the $T_g$ or the transition temperature of the soft segment, but lower than the $T_g$ or melting point of the hard segment. The temporary shape is set while processing the material at the transition temperature of the soft segment followed by cooling to fix the shape. The material can be reverted back to the permanent shape by heating the material above the transition temperature of the soft segment. For example, the material may present a spring having a first modulus of elasticity when activated and second modulus when deactivated.

The temperature needed for permanent shape recovery can be set at any temperature between about −63° C. and about 120° C. or above. Engineering the composition and structure of the polymer itself can allow for the choice of a particular temperature for a desired application. A preferred temperature for shape recovery is greater than or equal to about −30° C., more preferably greater than or equal to about 0° C., and most preferably a temperature greater than or equal to about 50° C. Also, a preferred temperature for shape recovery is less than or equal to about 120° C., and most preferably less than or equal to about 120° C. and greater than or equal to about 80° C.

Suitable shape memory polymers include thermoplastics, thermosets, interpenetrating networks, semi-interpenetrating networks, or mixed networks. The polymers can be a single polymer or a blend of polymers. The polymers can be linear or branched thermoplastic elastomers with side chains or dendritic structural elements. Suitable polymer components to form a shape memory polymer include, but are not limited to, polyphosphazenes, poly(vinyl alcohols), polyamides, polyester amides, poly(amino acid)s, polyanhydrides, polycarbonates, polyacrylates, polyalkylenes, polyacrylamides, polyalkylene glycols, polyalkylene oxides, polyalkylene terephthalates, polyortho esters, polyvinyl ethers, polyvinyl esters, polyvinyl halides, polyesters, polylactides, polyglycolides, polysiloxanes, polyurethanes, polyethers, polyether amides, polyether esters, and copolymers thereof. Examples of suitable polyacrylates include poly(methyl methacrylate), poly(ethyl methacrylate), poly(butyl methacrylate), poly (isobutyl methacrylate), poly(hexyl methacrylate), poly(isodecyl methacrylate), poly(lauryl methacrylate), poly(phenyl methacrylate), poly(methyl acrylate), poly(isopropyl acrylate), poly(isobutyl acrylate) and poly(octadecyl acrylate). Examples of other suitable polymers include polystyrene, polypropylene, polyvinyl phenol, polyvinylpyrrolidone, chlorinated polybutylene, poly(octadecyl vinyl ether) ethylene vinyl acetate, polyethylene, poly(ethylene oxide)-poly (ethylene terephthalate), polyethylene/nylon (graft copolymer), polycaprolactones-polyamide (block copolymer), poly (caprolactone) dimethacrylate-n-butyl acrylate, poly (norbornyl-polyhedral oligomeric silsequioxane), polyvinylchloride, urethane/butadiene copolymers, polyurethane block copolymers, styrene-butadiene-styrene block copolymers, and the like.

Thus, for the purposes of this invention, it is appreciated that SMP's exhibit a dramatic drop in modulus when heated above the glass transition temperature of their constituent that has a lower glass transition temperature. If loading/deformation is maintained while the temperature is dropped, the deformed shape will be set in the SMP until it is reheated while under no load under which condition it will return to its as-molded shape. While SMP's could be used variously in block, sheet, slab, lattice, truss, fiber or foam forms, they require continuous power to remain in their lower modulus state.

Finally, suitable magnetorheological fluid materials include, but are not intended to be limited to, ferromagnetic or paramagnetic particles dispersed in a carrier fluid. Suitable particles include iron; iron alloys, such as those including aluminum, silicon, cobalt, nickel, vanadium, molybdenum, chromium, tungsten, manganese and/or copper; iron oxides, including Fe2O3 and Fe3O4; iron nitride; iron carbide; carbonyl iron; nickel and alloys of nickel; cobalt and alloys of cobalt; chromium dioxide; stainless steel; silicon steel; and the like. Examples of suitable particles include straight iron powders, reduced iron powders, iron oxide powder/straight iron powder mixtures, and iron oxide powder/reduced iron powder mixtures. A preferred magnetic-responsive particulate is carbonyl iron, preferably, reduced carbonyl iron.

The particle size should be selected so that the particles exhibit multi-domain characteristics when subjected to a magnetic field. Diameter sizes for the particles can be less than or equal to about 1,000 micrometers, with less than or equal to about 500 micrometers preferred, and less than or equal to about 100 micrometers more preferred. Also preferred is a particle diameter of greater than or equal to about 0.1 micrometer, with greater than or equal to about 0.5 more preferred, and greater than or equal to about 10 micrometers especially preferred. The particles are preferably present in an amount between about 5.0 to about 50 percent by volume of the total MR fluid composition.

Suitable carrier fluids include organic liquids, especially non-polar organic liquids. Examples include, but are not limited to, silicone oils; mineral oils; paraffin oils; silicone copolymers; white oils; hydraulic oils; transformer oils; halogenated organic liquids, such as chlorinated hydrocarbons, halogenated paraffins, perfluorinated polyethers and fluorinated hydrocarbons; diesters; polyoxyalkylenes; fluorinated silicones; cyanoalkyl siloxanes; glycols; synthetic hydrocarbon oils, including both unsaturated and saturated; and combinations comprising at least one of the foregoing fluids.

The viscosity of the carrier component can be less than or equal to about 100,000 centipoise, with less than or equal to about 10,000 centipoise preferred, and less than or equal to about 1,000 centipoise more preferred. Also preferred is a viscosity of greater than or equal to about 1 centipoise, with greater than or equal to about 250 centipoise preferred, and greater than or equal to about 500 centipoise especially preferred.

Aqueous carrier fluids may also be used, especially those comprising hydrophilic mineral clays such as bentonite or hectorite. The aqueous carrier fluid may comprise water or water comprising a small amount of polar, water-miscible organic solvents such as methanol, ethanol, propanol, dimethyl sulfoxide, dimethyl formamide, ethylene carbonate, propylene carbonate, acetone, tetrahydrofuran, diethyl ether, ethylene glycol, propylene glycol, and the like. The amount of polar organic solvents is less than or equal to about 5.0% by volume of the total MR fluid, and preferably less than or equal to about 3.0%. Also, the amount of polar organic solvents is preferably greater than or equal to about 0.1%, and more preferably greater than or equal to about 1.0% by volume of the total MR fluid. The pH of the aqueous carrier fluid is preferably less than or equal to about 13, and preferably less than or equal to about 9.0. Also, the pH of the aqueous carrier fluid is greater than or equal to about 5.0, and preferably greater than or equal to about 8.0.

Natural or synthetic bentonite or hectorite may be used. The amount of bentonite or hectorite in the MR fluid is less than or equal to about 10 percent by weight of the total MR fluid, preferably less than or equal to about 8.0 percent by weight, and more preferably less than or equal to about 6.0 percent by weight. Preferably, the bentonite or hectorite is present in greater than or equal to about 0.1 percent by weight, more preferably greater than or equal to about 1.0 percent by weight, and especially preferred greater than or equal to about 2.0 percent by weight of the total MR fluid.

Optional components in the MR fluid include clays, organoclays, carboxylate soaps, dispersants, corrosion inhibitors, lubricants, extreme pressure anti-wear additives, antioxidants, thixotropic agents and conventional suspension agents. Carboxylate soaps include ferrous oleate, ferrous naphthenate, ferrous stearate, aluminum di- and tri-stearate, lithium stearate, calcium stearate, zinc stearate and sodium stearate, and surfactants such as sulfonates, phosphate esters, stearic acid, glycerol monooleate, sorbitan sesquioleate, laurates, fatty acids, fatty alcohols, fluoroaliphatic polymeric esters, and titanate, aluminate and zirconate coupling agents and the like. Polyalkylene diols, such as polyethylene glycol, and partially esterified polyols can also be included.

Similarly MR elastomer materials include, but are not intended to be limited to, an elastic polymer matrix comprising a suspension of ferromagnetic or paramagnetic particles, wherein the particles are described above. Suitable polymer matrices include, but are not limited to, poly-alpha-olefins, natural rubber, silicone, polybutadiene, polyethylene, polyisoprene, and the like.

II. Exemplary Configurations and Applications

Figure 6:
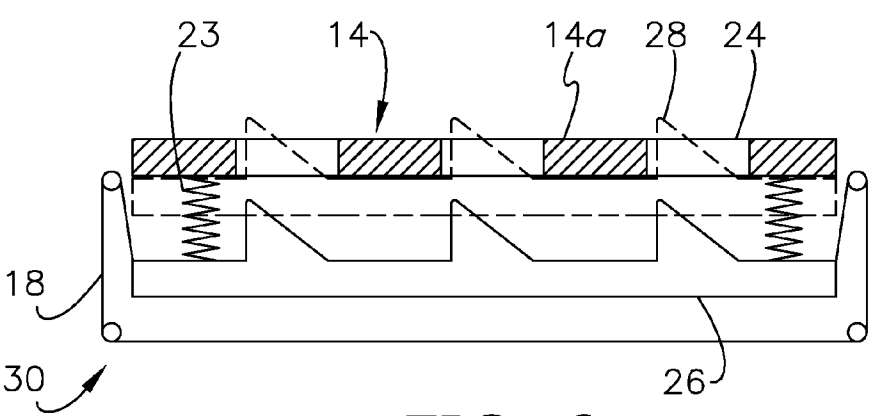
FIG. 6 is an elevation of a component edge defining a plurality of holes, and including a back plate defining a plurality of protuberances in recessed (continuous-line type) and deployed (hidden-line type) conditions, in accordance with a preferred embodiment of the invention.
Figure 5:
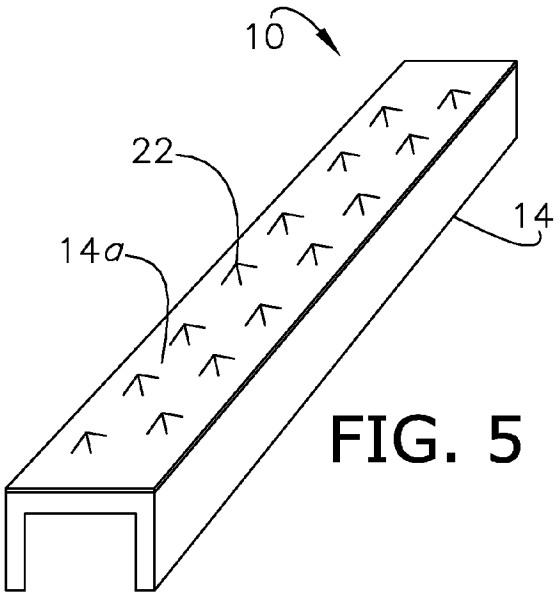
FIG. 5 is a perspective view of a component edge having at least one active material element embedded therein, that functions to alter the surface texture of the component upon activation, in accordance with a preferred embodiment of the invention.

Turning now to the structural configuration and operation of the invention, various exemplary embodiments of a pinch protection mechanism 10 are show in FIGS. 1-10. The invention concerns pinch protection mechanisms 10 whose embodiments can be categorized in three types: mechanisms that prevent pinch conditions from occurring, mechanisms that warn of imminent pinch conditions, and mechanisms that mitigate pinch conditions (i.e., reduces the force incurred by the obstruction 16). Exemplary pinch prevention mechanisms 10 are shown in FIGS. 1-4; exemplary pinch warning mechanisms are shown in FIGS. 5 and 6; and exemplary pinch mitigation mechanisms are shown in FIGS. 7-10.

As previously mentioned, the structural component 14 defines a manipulable edge (i.e., perimeter or "edge section") 14*a* that engages the closure panel 12 when in the closed position. In the preferred embodiment, the edge 14*a* is either directly or indirectly coupled to an active material element 18, which, when activated (or deactivated), is operable to cause or enable the edge 14*a* to achieve a second configuration. As a result of achieving the second configuration, the pinch condition is eliminated, mitigated, or a warning is generated. The element 18 comprises an active material as described in Part I, including, but not limited to, shape memory alloy, shape memory polymer, EAP, piezoelectric composites, paraffin wax, shear thinning fluids, and/or ER/MR fluids and elastomers. An active material element 18 may be further used to detect a pinch condition and initiate actuation, for example, wherein a piezoelectric load sensor(s) is employed.

In FIGS. 1 and 1*a*, a preferred embodiment of a pinch protection mechanism 10 is shown, wherein the edge 14*a* is overlaid by the active material element 18, shown as a thin planar cover. A portion (e.g., half) of the element 18 distal to the closure panel 12 is fixedly secured to, while the opposite portion of the element 18 proximal to the closure panel 12 is detached from the edge 14*a*. The element 18 is continuous along the edge 14*a* of the component 14 to create a smooth surface upon which an obstruction 16 may rest. In this and throughout the embodiments, at least one sensor 20 (FIG. 1*a*) is operable to cause an activation signal to be sent to the element 18 (e.g., through a controller (not shown)), when the closure panel 12 begins to move toward the closed position, and an obstruction 16 is detected, so as to effect autonomous operation.

Upon receiving the signal, the element 18 will undergo a change in a fundamental property, such that the proximal end of the element 18 will retract laterally and/or vertically causing it to curl away from the path of the panel 12 (FIG. 1*a*). This forces the obstruction 16 to move away from the path, thus avoiding a pinch condition. As such, the element 18 is sufficiently configured (geometrically and structurally) to remove foreseeable obstructions 16 far enough away from the path to avoid the pinch condition. Finally, the element 18 preferably reverts to the first configuration upon cessation of the signal, which may be triggered, for example, where the sensors 20 no longer detect the obstruction 16. The timing of the return of the element 18 and closure of the panel 12 are cooperatively configured to result in proper closure of the panel 12. Alternatively, a return mechanism, such as a spring-steel layer (not shown) in a bi-layer cover 18 may be added to that end.

A second embodiment is shown in FIG. 2, wherein a plurality of individual elements (e.g., strips or beams) 18 are coupled to the structural component 14, and function similar to the cover in FIG. 1. In this configuration, the plural elements 16 are off-centered such that foreseeable obstructions (e.g., hands, fingers, etc.) resting upon the edge 14*a* must engage at least one element 18. Upon activation, the proximal portion of each element 18 will retract away from the path of the panel 12. Once the obstruction 16 has been removed or after a time-out period, but before closure is complete, the element 18 is preferably deactivated, and returns to its superjacent configuration with the edge 14*a*. Due to the reduction in active material afforded by the spacing between elements, it is appreciated that less energy will be required to move the strips 18 than the continuous cover; and even less would be required to activate only those elements 18 that are engaged with the obstruction 16. To that end, the preferred mechanism 10 includes means for determining which elements 18 are currently engaging an obstruction 16, and may employ plural individually associated (e.g., piezoelectric load) sensors 20 to that end.

FIG. 3 depicts a third embodiment of a pinch prevention mechanism 10, wherein an active material element 18 again overlays the edge 14*a*. Unlike the previous embodiments, however, both longitudinal ends of the active material element 18, in this configuration, are coupled to the component 14. The end distal to the closure panel 12 is coupled pivotally, and the end proximal to the closure panel 12 is coupled both pivotally and translatably. Upon activation, the proximal end is caused to move toward the distal end (either directly or through the release of stored energy), such that the midsection of the element 18 is caused to bow outward. As such, obstructions 16 resting on the element 18 are translated both up and away from the edge 14*a*. This embodiment could be used with a plurality of elements 18, as shown in FIG. 2, wherein it is again preferable to activate only those elements 18 engaged with an obstruction 16.

Lastly, the pinch prevention mechanism 10 shown in FIGS. 1 and 2 may be modified to further function as a latch, as depicted in the progression shown in FIGS. 4*a-d*. Here, the distal end of an active material cover 18 is fixedly coupled to the structural component 14, as previously presented in FIG. 1, but the end proximal to a traverse closure panel 12 (or a traverse lip 12*a* of a vertical panel 12) extends past the edge 14*a*, so as to overlay the panel path. The element 18 in the default straightened configuration prevents the panel 12 from opening if closed (FIG. 4*a*), or fully closing if opened. This configuration ensures that any obstruction 16 that would be subject to a pinch condition must rest on the element 18. Upon activation, the element 18 undergoes a shape memory induced action, which causes it to retract (e.g., curl), so as to no longer overlay the path. This allows the panel 12 to open when closed (FIG. 4*b*), translate to the fully closed position when opened, and drives an obstruction 16 engaged therewith from the path (FIG. 4*d*), thereby preventing pinch conditions.

The second category of pinch prevention mechanisms encompassed by the present invention is pinch warning. These mechanisms 10 generally alter the surface texture of the soon-to-be engaged edge 14*a* to alert the user of an imminent pinch condition. A preferred embodiment of a pinch warning mechanism 10 is shown in FIG. 5. Here, a structural component 14 includes at least one active material element 18 embedded beneath the top surface of the edge 14*a*. The element 18 is configured such that any obstruction 16 engaged with the edge 14*a* will come in contact with at least a portion thereof. In the first configuration, the element 18 is preferably configured such that the edge 14*a* is smooth to the touch. Upon activation, the element 18, e.g., through shape memory, is caused to achieve a second configuration, wherein a plurality of raised surface anomalies 22 form upon the edge 14*a* (FIG. 5). The anomalies 22 are configured to form a haptic alert to a user, but not pose a danger. Alternatively, it is appreciated that haptic alert may be provided through a change in stiffness, for example, as produced by the activation of an MR Fluid disposed within a bladder defining the edge 14*a*.

FIG. 6 illustrates another example of a pinch warning mechanism 10, wherein the structural component 14 defines a matrix of holes 24 spaced and geometrically configured such that a foreseeable obstruction 16 engaging the edge 14*a* is caused to come in contact with at least one and more preferably a plurality of holes 24. Adjacent the edge 14*a* is a translatable plate 26 having stemming therefrom a plurality of protuberances 28, which are positioned and configured, so as to be coaxially aligned with and inserted within the holes 24. The preferred protuberances 28, in this configuration, generally define rounded edges or points at their apex, as shown in FIG. 6, so as to again generate a haptic warning without posing a danger. An actuator 30 preferably employing an active material element 18 (e.g., a bow-string SMA wire) is operable to selectively move the plate 26 relative to the component 14, e.g., as a result of activating the element 18. In the non-deployed configuration, the plate 26 is configured, such that the protuberances 28 are normally recessed, thereby providing a smooth surface at the edge 14*a*. Finally, in FIG. 6, there is shown first and second compression return springs 23 intermediately disposed between the plate 26 and component 14 that bias the plate 26 towards the recessed condition.

Figure 7:
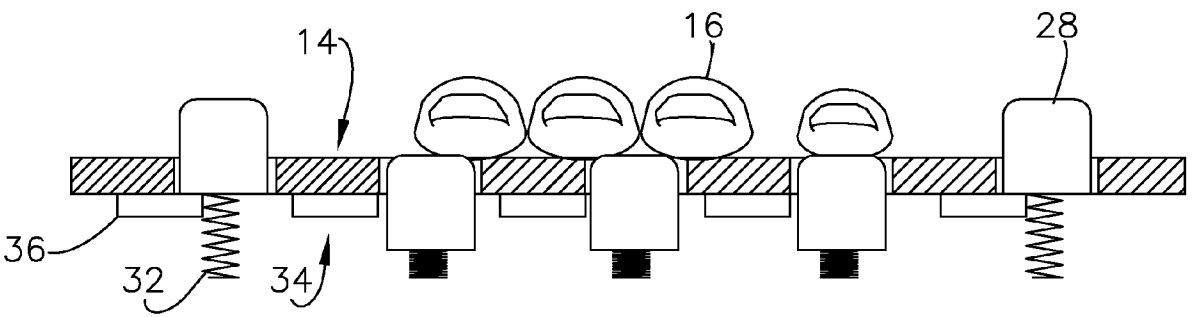
FIG. 7 is an elevation of a component edge defining a plurality of holes, and including a plurality of spring-biased protuberances disposed within the holes, wherein a portion of the protuberances have been engaged by an obstruction, so as to cause the remaining protuberances to protrude from the edge, and a cavity to form around the obstruction, in accordance with a preferred embodiment of the invention.

In the third category, the mechanism 10 mitigates pinch conditions by creating a space for obstructions 16, a breakaway edge 14*a*, or a softer/more facilely deformed edge 14*a*. In FIG. 7, for example, a mechanism 10 similar to the one in FIG. 6 is presented, wherein a structural component 14 again defines a plurality of holes 24. The holes 24 are spaced and geometrically configured such that any foreseeable obstruction 16 coming in contact with the edge 14*a* is caused to engage at least one hole 24. A plurality of preferably cylindrical protuberances 28 are coaxially aligned with the holes 24 of the component 14. Unlike in FIG. 6, however, these protuberances 28 are independently moveable, such that only those not in contact with an obstruction 16 are able to protrude from the surface of the edge 14*a*. In a preferred embodiment (not shown), the protuberances 28 are in a normally recessed position relative to the surface of the edge 14*a*, so as to produce a smooth surface. Here, a plurality of actuators 30, again preferably comprising active material elements 18, are drivenly coupled to the protuberances 28, and are operable to cause the protuberances 28 to extend from the edge 14*a*, either individually or as a unit, when closure of the panel 12 is initiated. The protuberances 28 are then automatically locked in the extended position. It is appreciated in this configuration that the mechanism 10 serves to both generate a haptic warning caused by the actuation pressure exerted upon the depressed protuberances 28, and a mitigating cavity, where the obstruction 16 persists.

Alternatively, and as shown in FIG. 7, the protuberances 28 may be biased towards the extended condition by a plurality of springs 32, and more preferably, shape memory alloy springs, so as to enable attenuation. In this configuration, the mechanism 10 includes a locking mechanism (i.e., "lock") 34 operable to selectively engage and retain the non-engaged protuberances 28 in the extended condition (FIG. 7). For example, a plurality of individual sliders 36 may be selectively shiftable between clear and supporting positions relative to each protuberance 28. In FIG. 7, when a protuberance 28 is extended, but at least one protuberance engages an obstruction 16, so as to remain recessed, the associated sliders 36 are caused to slide partially underneath, thereby locking the protuberances 28 in place; for example, by a secondary SMA actuator (not shown). As a result, a protective cavity is created around the obstruction 16 that eliminates or reduces the closing force borne by the object 16 during pinching. Finally, it is appreciated that the lock 34 includes retraction means (not shown) drivenly coupled to the sliders 36 and operable to cause the sliders 36 to slide back to the clear position, so as to reset the pinch prevention mechanism 10 once the condition is alleviated (e.g., the obstruction 16 is removed, or closure of the panel 12 is ceased).

Figure 8:
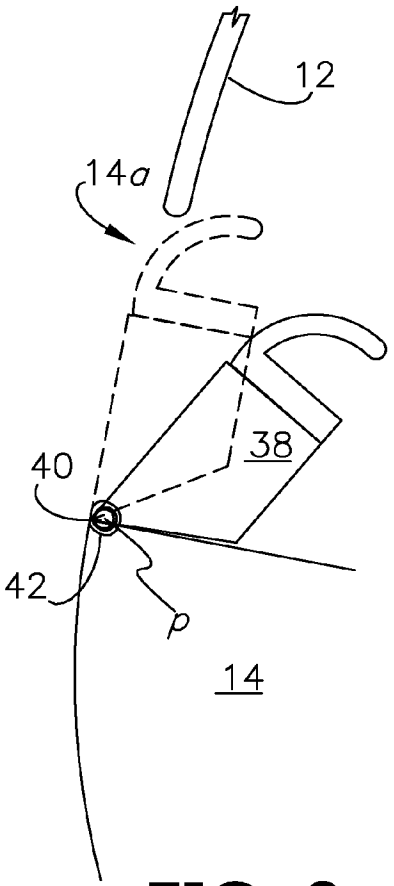
FIG. 8 is an elevation of a rotatable component edge comprising a pivotal member, and an active material hinge, shown in obstruction unengaged (hidden-line type) and engaged (continuous-line type) conditions, in accordance with a preferred embodiment of the invention.

Another embodiment of a pinch mitigation mechanism 10 is shown in FIG. 8, wherein the component 14 includes and the edge 14*a* is defined by a pivotal member 38 (shown as an appliqué and conformable seal). In a preferred embodiment, an active material (e.g., SMP) hinge 40 fixedly couples the member 38 and remaining structural component, and defining a pivot axis, p. The hinge 40, in a first configuration, presents a normal resistance suitable to seal the member 38 and closure panel 12, when the panel 12 is in the closed position. Upon activation, the hinge 40 achieves a lower impedance to bending that allows the edge 14*a* to break-away, when at least a portion of the closure force is received through an obstruction 16. Where Austenitic SMA is used in the hinge construction, it is appreciated that the member 38 may be configured such that the activation signal is the applied force. Alternatively, a torsion spring 42 coaxially aligned with the pivot axis may be drivenly coupled to the edge 14*a*, in lieu of or addition to the hinge 40, so as to aid in biasing the edge 14*a* towards the first configuration. More preferably, the spring 42 is also comprised of active material so as to similarly present first and second tunable impedances to pivoting.

In this configuration, the preferred mechanism 10 further includes a lock 34 (FIG. 9) that functions to selectively prevent the member 38 from pivoting when undesired (e.g., in an unauthorized attempt to compromise the engagement). In the illustrated embodiment, the lock 34 includes a support structure 44 fixedly coupled to the component 14 preferably along the pivot axis of the member 38, or to an otherwise fixed structure. The structure 44 at a lateral end of the member 38 and edge 14*a* defines an end cap 46 that longitudinally extends traversly to the pivot axis. The end cap 46 defines a race within which a spring biased pawl 48 linearly translates between engaged and disengaged conditions relative to a rigid connecting element 50 of the member 38. In the engaged position, the pawl 48 fixes the connecting element 50 and therefore prevents the member 38 from pivoting. An active material (e.g., SMA) wire 18 is connected to the pawl 48, passes through a hole defined by the cap 46, and interconnects to fixed structure (not shown) at its opposite end. The wire 18 is operable, when activated, to pull the pawl 48, and compress the spring 52, so as to disengage the pawl 48 and connecting element 50, thereby allowing pinch mitigation to occur. Once deactivated, the spring 52 acts to return the pawl 48 and element 50 to the engaged condition. Control may be provided to effect activation of the wire 18 only when the panel 12 is opened logically.

Figure 10:
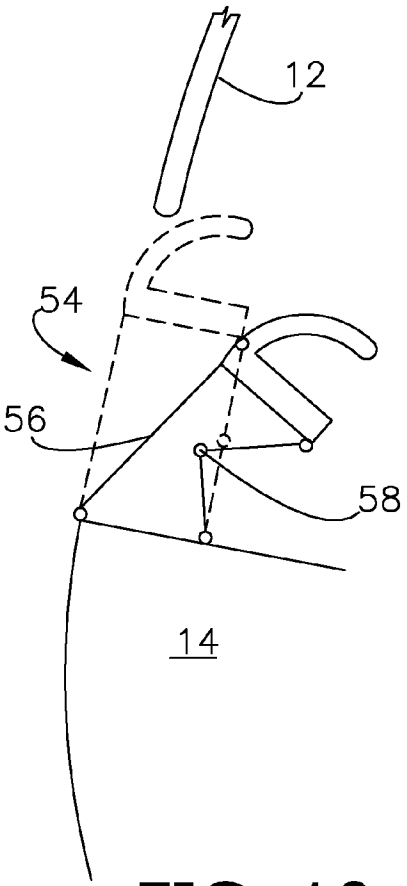
FIG. 10 is an elevation of a foldable component edge, comprising an active material based four bar linkage, in accordance with a preferred embodiment of the invention.
Figure 9:
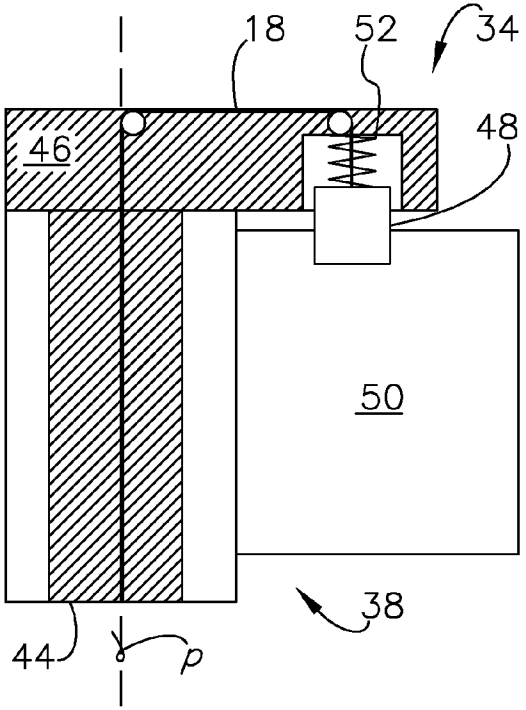
FIG. 9 is a cross-section of the member shown in FIG. 8, and further includes a locking mechanism engaging the component edge, in accordance with a preferred embodiment of the invention.

In FIG. 10, the mechanism 10 operates similarly to the mechanism 10 shown in FIG. 8, but includes a four bar linkage 54 that engages the panel 12, instead of the pivotal member 38. The term "four-bar linkage" shall be understood to refer to a movable linkage consisting of four rigid elements 56, each attached to the adjacent two others by a joint 58, and pivots to form a closed loop. In this embodiment, at least one joint 58 comprises one or more active material element 18 (e.g., an SMA or SMP torsion spring), and functions similar to the hinge 40. That is to say, in the event of a pinch condition, the element(s) 18 is activated to achieve a reduced impedance state, which allows the linkage 40 to collapse, and the edge 14*a* to break-away when caused to engage the closure force. Alternatively, at least one rigid element 56 may comprise the active material and present a fold line in lieu of a joint.

Finally, it is appreciated that a pinch event may be mitigated in terms of severity by softening the edge 14*a*, such as, for example, by heating SMP included therein. Alternatively, mitigation can be provided by impact/high speed loading of shear thinning fluids, when a pinch condition is predicted, which would lead to the edge component 14 containing them becoming softer/more easily deformed during and as a consequence of the closure event.

Thus, in a preferred mode of operation presented by the present invention, an active material element 18 is secured relative and drivenly coupled to an edge 14*a* of a structural component 14 that engages with a closure panel 12. The element 18 is activated when the panel 12 is in the open position, and closure is initiated. More preferably, the element 18 is activated when closure is initiated and an obstruction 16 is detected. In this configuration, it is appreciated that the mechanism 10 may further include one or more sensors 20 communicatively coupled to the element 18 and operable to detect a pinch condition. Once activated, the edge 14*a* is modified to achieve a second configuration. As a result of modifying the edge 14*a*, the pinch condition is prevented, mitigated, or an alert is generated so that the obstruction 16 can be removed. The edge 14*a* is then returned to the first configuration, before or after the panel 12 achieves the closed position, and in one embodiment is further configured to present a latch that seals and holds the panel 12 in the closed position.

Ranges disclosed herein are inclusive and combinable (e.g., ranges of "up to about 25 wt %, or, more specifically, about 5 wt % to about 20 wt %", is inclusive of the endpoints and all intermediate values of the ranges of "about 5 wt % to about 25 wt %," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

Suitable algorithms, processing capability, and sensor inputs are well within the skill of those in the art in view of this disclosure. This invention has been described with reference to exemplary embodiments; it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A pinch-protection mechanism adapted for use with a closure panel, wherein the panel is moveable between open and closed positions, so as to define a closing path, said mechanism comprising:

at least one structural component defining an edge; and a shape memory active material element overlaying at least a portion of the edge and having at least one end that is fixedly coupled to the edge, the shape memory active material element operable to undergo a reversible change in shape when exposed to or occluded from an activation signal, such that the change causes or enables the shape memory active material element to move to one of a first configuration in the closing path or a second configuration away from the closing path.

2. The mechanism as claimed in claim 1, wherein the shape memory active material element is selected from the group consisting of shape memory alloys (SMA), shape memory polymers, and ferromagnetic shape memory alloys.

3. The mechanism as claimed in claim 1, wherein the at least one end of the shape memory active material element fixedly coupled to the edge is distal to the closure panel, wherein the shape memory active material element is continuous along the edge in the first configuration, and wherein an other end of the shape memory active material element that is proximal to the closure panel is bent away from the edge in the second configuration so as to remove obstructions engaged therewith from the closing path.

4. The mechanism as claimed in claim 1, wherein the at least one end of the shape memory active material element fixedly coupled to the edge is distal to the closure panel; wherein an other end of the shape memory active material element is proximal to the closure panel, extends past the edge, and overlays the panel path in the first configuration, so as to prevent the closure panel from moving from the closed position to the open position or vice versa; and wherein the other end of the element retracts out of the panel path in the second configuration.

5. The mechanism as claimed in claim 3, wherein the mechanism includes a plurality of the shape memory active material elements configured as equally spaced longitudinal strips.

6. The mechanism as claimed in claim 1, wherein the at least one end is a first longitudinal end and wherein the shape memory active material element includes a second longitudinal end, wherein the first longitudinal end is pivotally coupled to the component, the second longitudinal end is pivotally and translatably coupled to the component, and the change causes the second longitudinal end to translate towards the first longitudinal end and causes the element to bow from the edge.

7. The mechanism as claimed in claim 1, wherein the signal is a force of a preselected magnitude.

8. The mechanism as claimed in claim 1, further comprising:

a sensor communicatively coupled to the shape memory active material element, and operable to detect an obstruction and cause the change when the obstruction is detected.

9. The mechanism as claimed in 8, wherein the sensor is a piezo-based sensor.

10. A method of preventing a pinch condition between the edge of the structural component of the pinch-protection mechanism as claimed in claim 1 and the closure panel manipulable between open and closed positions, wherein the closure panel is spaced from and engages the edge respectively, said method comprising the steps of:

a. securing the shape memory active material element such that the shape memory active material element overlays at least a portion of the edge and has one end fixedly coupled to the edge;

b. detecting an obstruction in the closing path when the closure panel is moving toward the closed position;

c. transmitting the activation signal to the shape memory active material element in response to the detecting of the obstruction, thereby activating the shape memory active material element and modifying a shape of the shape memory active material element to the second configuration that is away from the closing path;

d. preventing the pinch condition as a result of modifying the shape of the shape memory active material element;

e. detecting an absence of the obstruction in the closing path; and f. ceasing transmission of the activation signal in response to the detecting of the absence of the obstruction, thereby returning the shape memory active material element to the first configuration that is in the closing path before the closure panel achieves the closed position.

* * * * *